US006917006B2

(12) United States Patent
Bachofen

(10) Patent No.: US 6,917,006 B2
(45) Date of Patent: Jul. 12, 2005

(54) SPRING-DRIVEN MECHANISM FOR RECTILINEAR DISPLACEMENT CIRCUIT BREAKER

(75) Inventor: Félix Bachofen, Oberentfelden (CH)

(73) Assignee: Areva T&D SA, Levallois Perret (FR)

( * ) Notice: Subject to any disclaimer, the term of this patent is extended or adjusted under 35 U.S.C. 154(b) by 0 days.

(21) Appl. No.: 10/501,862

(22) PCT Filed: Feb. 14, 2003

(86) PCT No.: PCT/FR03/00175

§ 371 (c)(1),
(2), (4) Date: Jul. 19, 2004

(87) PCT Pub. No.: WO03/066407

PCT Pub. Date: Aug. 14, 2003

(65) Prior Publication Data

US 2004/0262141 A1 Dec. 30, 2004

(30) Foreign Application Priority Data

Feb. 19, 2002 (FR) ..... 02 02092

(51) Int. Cl.[7] ..... H01H 5/00

(52) U.S. Cl. ..... 200/400; 200/401; 200/318.2; 200/324; 218/154; 335/171

(58) Field of Search ..... 200/400, 401, 200/318.2, 324, 325, 327; 218/154; 335/171–179

(56) References Cited

U.S. PATENT DOCUMENTS 3,138,676 A * 6/1964 Gratzmuller ..... 200/82 B
4,654,494 A * 3/1987 Wuthrich ..... 200/337
4,841,788 A * 6/1989 Thuries et al. ..... 74/2
5,508,487 A * 4/1996 Smith et al. ..... 218/154
5,512,869 A 4/1996 Thuries
5,571,255 A * 11/1996 Baginski et al. ..... 200/401
5,628,394 A * 5/1997 Benke et al. ..... 200/400
5,740,003 A * 4/1998 Seymour et al. ..... 361/115
5,756,952 A 5/1998 Thuries

FOREIGN PATENT DOCUMENTS

FR 2747502 10/1997
GB 537 180 6/1941

* cited by examiner

*Primary Examiner*—Richard K. Lee
(74) *Attorney, Agent, or Firm*—Oblon, Spivak, McClelland, Maier & Neustadt, P.C.

(57) ABSTRACT

An operating mechanism for a rectilinear motion circuit-breaker, for performing an open-close-reopen cycle, and operating on an operating rod of the circuit-breaker and including closing and opening springs. The opening spring operates on the operating rod. The closing spring operates on a crank end whose other end is connected to a shaft fastened to a flywheel and on which is mounted a closing cam cooperating with a roller on the operating rod. A closing pawl retains the closing spring in a compressed position, opening the closing pawl releasing the closing spring to rotate the cam, thereby closing the circuit-breaker and rearming the opening spring. A rearming motor couples to the shaft by a freewheel. A pawl triggers opening retaining the operating rod against force of the opening spring in the closed position of the circuit-breaker and is adapted to receive an opening command.

6 Claims, 7 Drawing Sheets

SPRING-DRIVEN MECHANISM FOR RECTILINEAR DISPLACEMENT CIRCUIT BREAKER

The present invention relates to a spring-loaded operating mechanism for a rectilinear motion circuit-breaker, for performing an open-close-reopen cycle, said mechanism operating on an operating rod of the circuit-breaker and comprising a closing spring and an opening spring which are coaxial, said opening spring being mounted around said operating rod, in a cylindrical casing fixed to the circuit-breaker, between a fixed bottom of the casing and a bearing member connected to the operating rod in the vicinity of its free end.

French patent 2 747 502 describes a circuit-breaker operating mechanism of the above kind which includes a reversible motor for rearming the closing spring, which motor is complicated to control because it is reversible. Also, on closing the circuit-breaker, the coupling between the end of the operating rod and a cylinder pushed by the closing spring is effected by means of retractable fingers, with the resulting risk of scoring.

An object of the present invention is to propose an operating mechanism which avoids these drawbacks, which is simpler, and in which surplus energy stored in the closing spring is recovered.

Thus the invention provides a spring-loaded operating mechanism for a rectilinear motion circuit-breaker, for performing an open-close-reopen cycle, said mechanism operating on an operating rod of the circuit-breaker and comprising a closing spring and an opening spring, said opening spring operating on said operating rod, characterized in that the closing spring operates on the end of a crank whose other end is connected to a shaft fastened to a flywheel and on which is mounted a closing cam which cooperates with a roller on said operating rod, in that a closing pawl retains the closing spring in a compressed position, opening this pawl releasing the closing spring and causing rotation of said cam in the direction in which it closes the circuit-breaker and rearms the opening spring, and in that it comprises a rearming motor coupled by a freewheel mechanism to said shaft, a pawl for triggering opening retaining the operating rod against the force of said opening spring in the closed position of the circuit-breaker and being adapted to receive an opening command.

Other features of the invention will emerge from the following description of one particular embodiment of the invention, which description is given with reference to the accompanying drawings, in which:

FIGS. 1, 2, 3 and 4 show diagrammatically a circuit-breaker operating mechanism with rectilinear springs for performing an open-close-reopen cycle of the circuit-breaker. In these figures, the mechanism is shown in a state corresponding to the closed position of the circuit-breaker, before the above cycle and therefore with both the opening and closing springs compressed.

Figure 2:
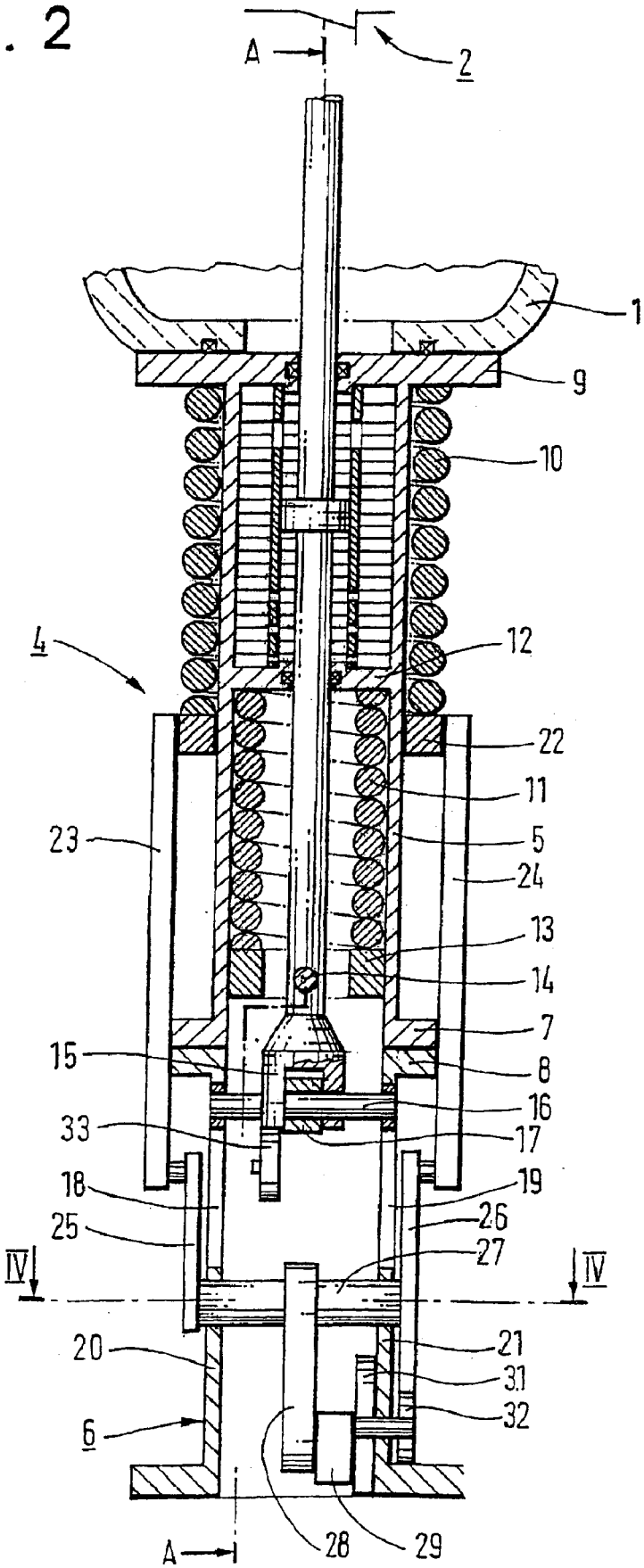
FIG. 2 is a view in section taken along the line II—II in FIG. 1.
Figure 3:
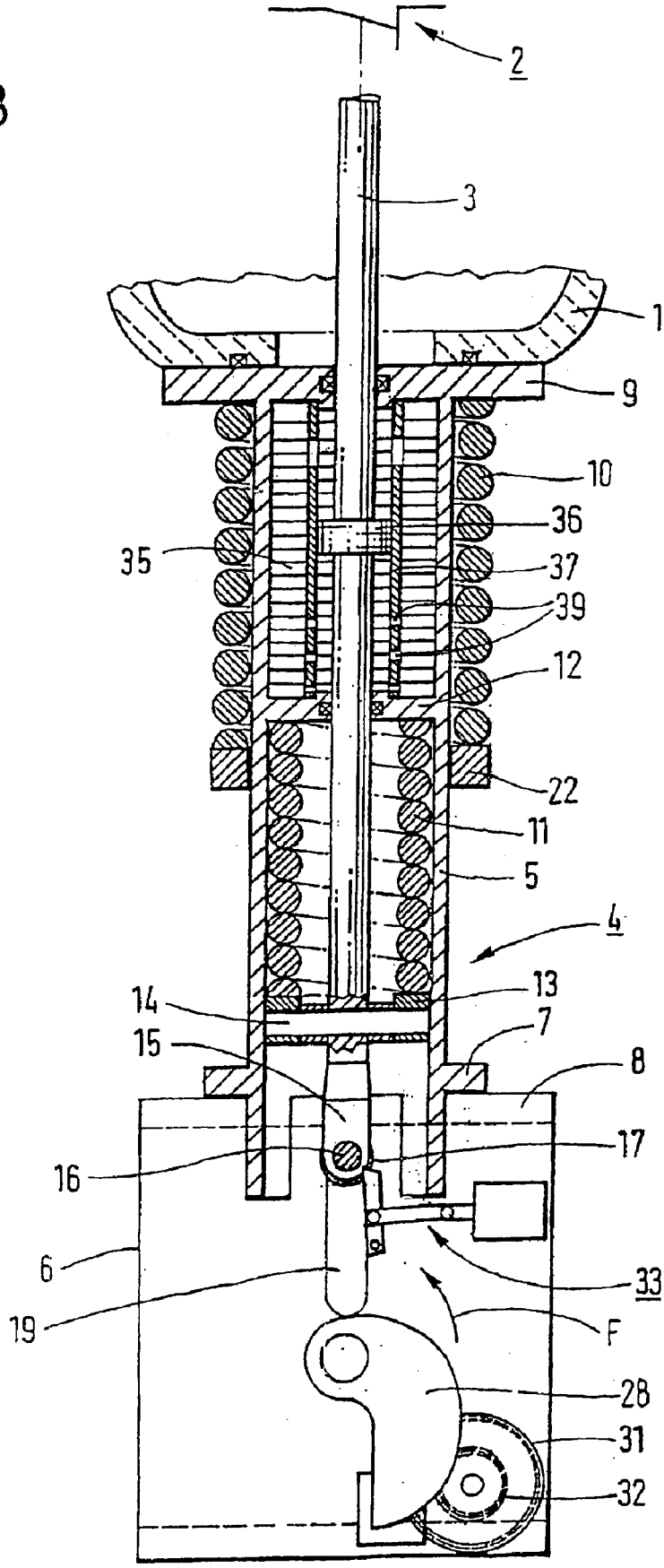
FIG. 3 is a view in section taken along the line A—A in FIG. 2 showing the mechanism in the same position as in FIGS. 1 and 2, i.e. in the closed position, with the closing spring compressed, prior to an open-close-reopen cycle of the circuit-breaker.
Figure 4:
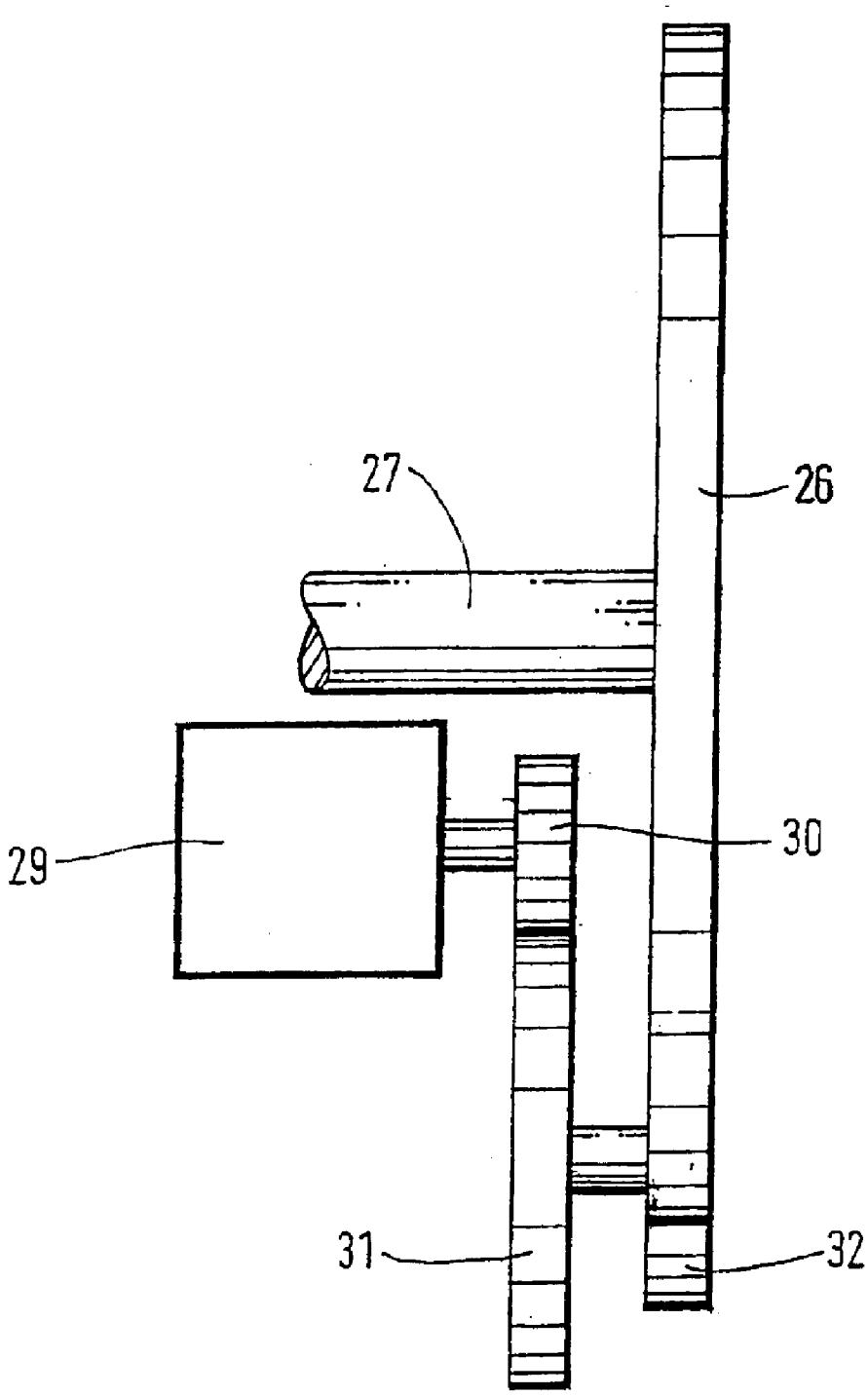
FIG. 4 is a partial view in section taken along the line IV—IV in FIG. 2.
Figure 5:
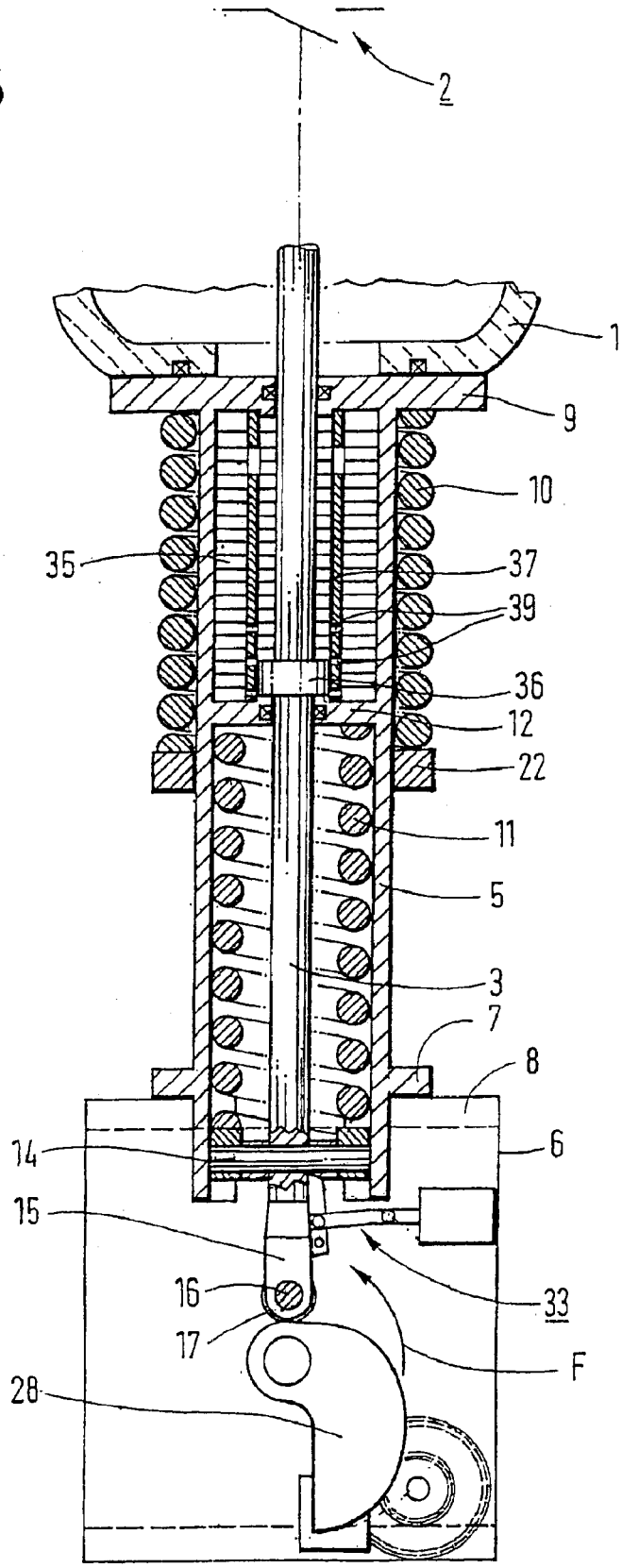
FIGS. 5 to 7 are views in section taken along the line A—A in FIG. 2 in respective states corresponding to the open-close-reopen cycle of the circuit-breaker.
Figure 6:
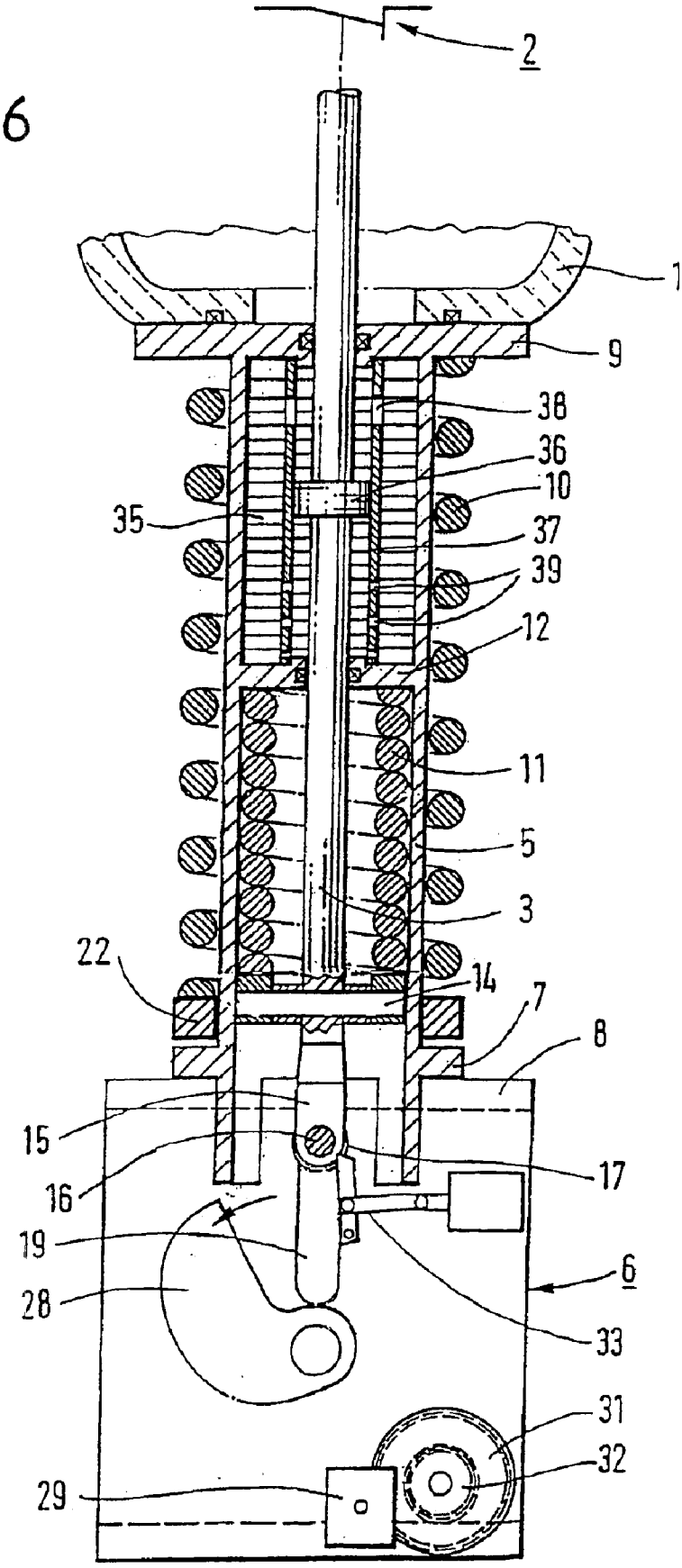

The circuit-breaker includes an insulative external enclosure 1, only part of which is shown, containing all the active components, and its function is symbolized by a switch 2 which is closed in FIGS. 1, 2, 3 and 5 and open in FIGS. 4 and 6. An operating rod 3 is connected to the mobile components in a manner that is known in the art.

The operating mechanism includes a fixed mechanism body 4 comprising a cylindrical casing 5 and a frame housing 6 connected together by flanges 7, 8. The mechanism body as a whole is fixed by a flange 9 to the insulative enclosure 1. The active portions of the mechanism include a closing coil spring 10 and a coaxial opening coil spring 11. The springs have rectilinear axes.

The opening spring 11 is mounted around the operating rod 3 inside the fixed cylindrical casing 5, bearing on the one hand against a fixed bottom 12 of the casing and on the other hand against a sliding ring 13 connected to the operating rod 3 by a pin 14 in the vicinity of the free end of the operating rod. The operating rod 3 terminates in a yoke 15 which carries a shaft 16 on which is mounted a roller 17.

The shaft 16 passes completely through the yoke 15 and its ends are guided in slots 18 and 19 formed in two opposite walls 20 and 21 of the frame housing 6.

The closing spring 10 surrounds the fixed cylindrical casing 5 and bears on the one hand against a shoulder formed by the flange 9 and on the other hand against a second sliding ring 22 which can slide along the cylindrical casing 5 and to which is articulated one end of each of two links 23 and 24 whose other ends are respectively articulated to a crank 25 and to a flywheel 26, the crank and the flywheel being fastened to a shaft 27 to which is connected a cam 28 adapted to cooperate with the roller 17 situated at the free end of the operating rod 3 to close the circuit-breaker.

Furthermore, a rearming motor 29 is coupled to the shaft 27 by means of the flywheel 26, which is externally toothed, and pinions 30, 31 and 32, the pinion 32 incorporating a freewheel mechanism.

Figure 1:
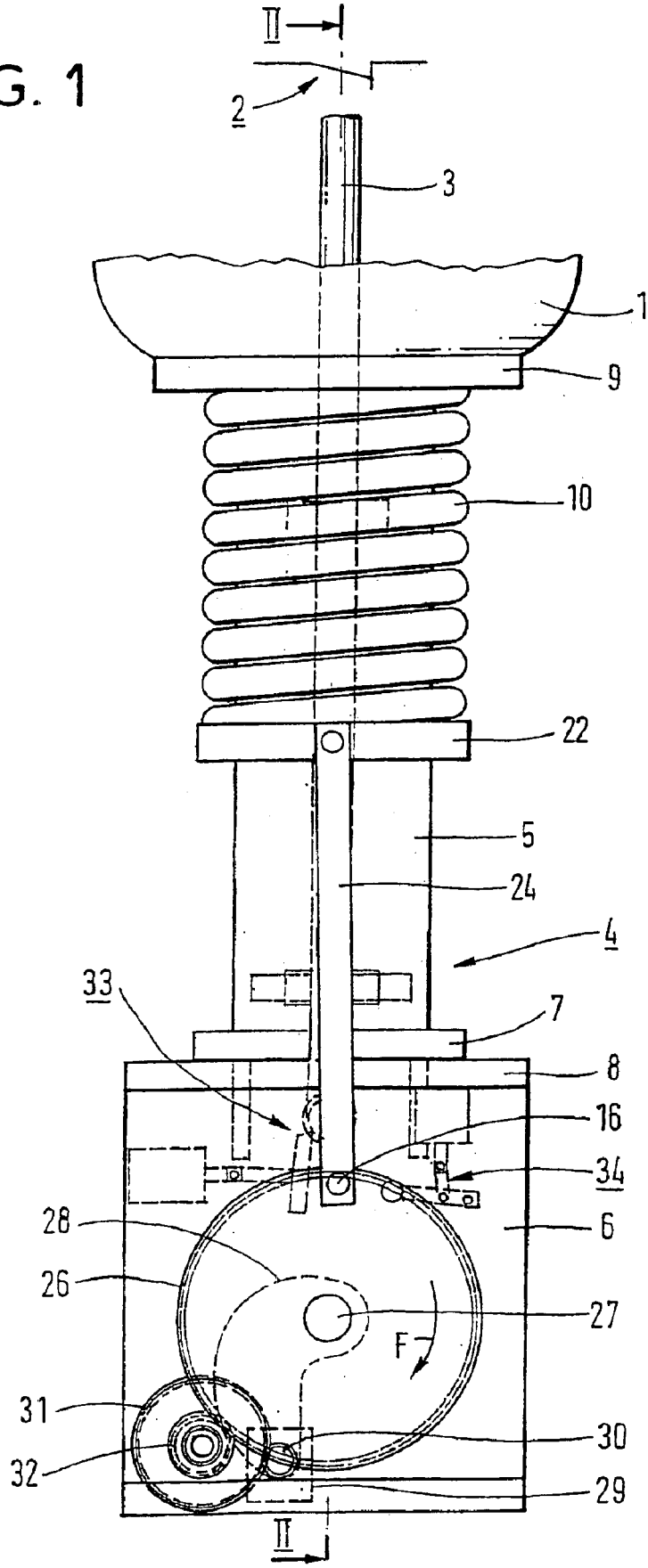
FIG. 1 is a view in elevation of a circuit-breaker operating mechanism according to the invention in a state corresponding to the closed position of the circuit-breaker and with the closing spring compressed.

The motor 29 is a one-way motor driving the toothed flywheel 26 and the cam 28 in the direction indicated by the arrows F in FIGS. 1 and 3. Finally, the mechanism includes a pawl 33 for triggering opening of the circuit breaker which holds the operating rod 3 in the position that corresponds to the closed position of the circuit-breaker with the opening spring 11 compressed.

This pawl withstands the force of the opening spring 11 and is opened by the operating system of the circuit-breaker, which system is not described. Unlocking opens the circuit-breaker. As can be seen clearly in FIG. 2, the pawl 33 presses on one branch of the yoke 15, and is therefore very close to the axis of the operating rod 3. A closing pawl 34 holds the closing spring 10 in the compressed position. This pawl interengages with the toothed flywheel 26 and, in the locked position (see FIG. 1), with the closing spring 10 compressed, the link 24 is in a position tending to drive the flywheel 26 and therefore the shaft 27 and the cam 28 in the direction of the arrow F, i.e. in the same direction as that in which the same components 26, 27, 28 are driven by the rearming motor 29. In this position, as can be seen in FIGS. 1, 2 and 3, the cam 28 is in a position enabling the circuit-breaker to open if the pawl 33 for triggering opening is triggered: this is the case for the position shown in FIG. 5.

In the FIG. 5 position, corresponding to the first opening position of the open-close-open cycle, if the closing pawl 34 is operated to disengage it, the power of the closing spring 10 is released, driving rotation of the flywheel 26 and therefore of the shaft 27 and the cam 28 in the direction of the arrow F, via the links 23, 24, and so closing the circuit-breaker, so that the position is then that corresponding to the Closed position of the Open-Close-Open cycle of the circuit-breaker (see FIG. 6). The pawl 33 for triggering opening is reset and the inertia acquired by the flywheel and the cam is recovered, partly recompressing the closing spring 10, and the cam therefore stops in an angular position beyond that needed to close the circuit-breaker (see FIG. 6). The pinions, the flywheel 26 or the rearming motor 29, for example, are provided with non-return means.

Figure 7:
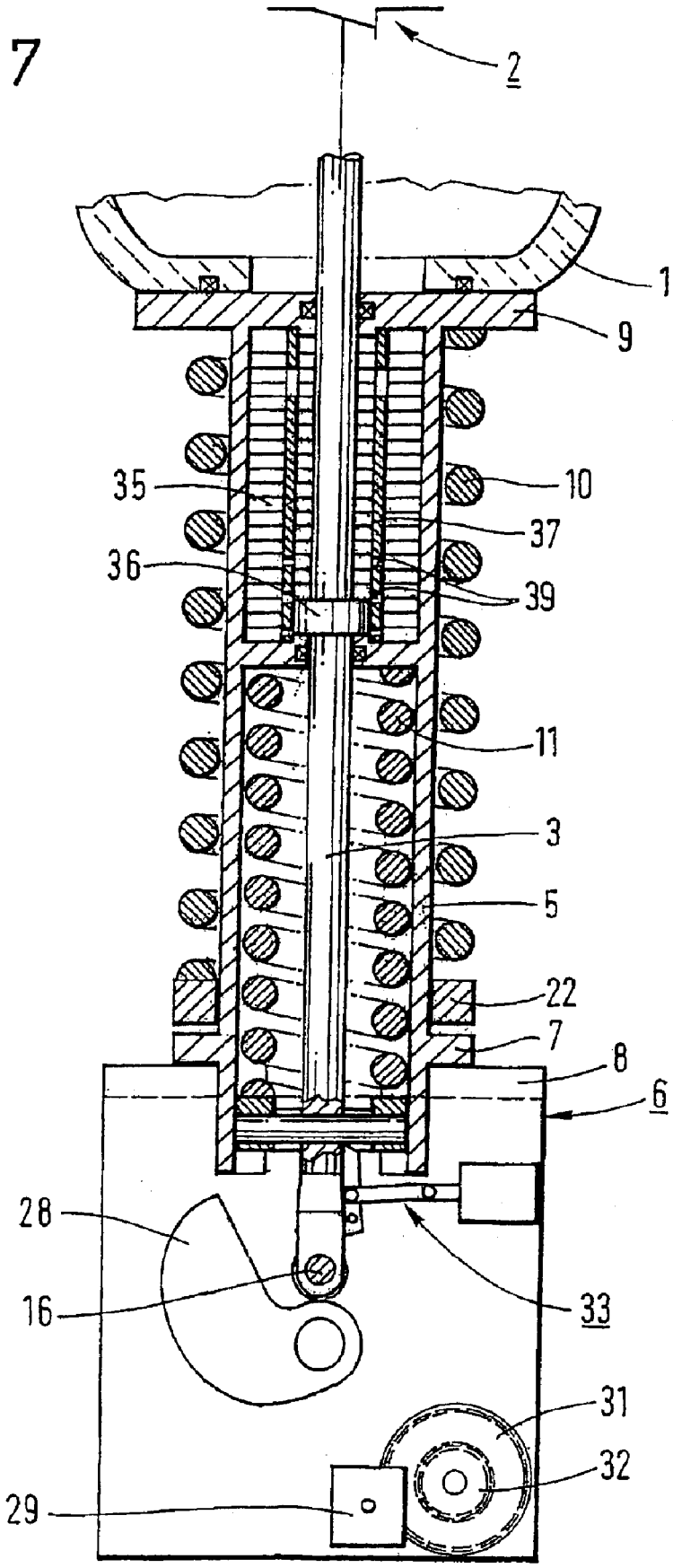

If the fault persists, the pawl 33 for triggering opening receives an opening command and the opening spring 11 relaxes, which causes the circuit-breaker to open: the two springs 10 and 11 are relaxed, the circuit-breaker is open, and the position is the second Open position of the Open-Close-Open cycle (see FIG. 7).

To return to the original closed position (see FIG. 1, 2 or 3), the motor 29 drives the flywheel until the cam is in the lowermost position, with the spring 10 compressed, and the pawl 34 is prevented from immobilizing the flywheel: due to the thrust of the spring 10, it relaxes again (with the cam in the uppermost position), closing the circuit-breaker, with the spring 11 compressed, the pawl 33 is reset, inertia drives the flywheel and the cam a little farther, and the motor takes over to complete the rotation of the flywheel and the cam into the position shown in FIGS. 1, 2 and 3, the spring 10 is compressed again, and the pawl 34 is reset. The freewheel pinion 32 is indispensable for this operation.

Thanks to the kinetic energy recovered from the flywheel and the cam at the end of a closing operation, the rating of the rearming motor 29 can be reduced.

In the example shown, and as seen in FIGS. 2, 3 and 5 to 7, the mechanism comprises a hydraulic damper comprising a chamber 35 in the cylindrical casing 5, above the fixed bottom 12. The operating rod 3 carries a piston 36 inside this chamber, moving in a cylinder formed by a tube 37 pierced with holes 38, 39. The whole of the chamber is filled with a liquid.

What is claimed is:

1. A spring-loaded operating mechanism for a rectilinear motion circuit-breaker, for performing an open-close-reopen cycle, said mechanism operating on an operating rod of the circuit-breaker and comprising:

a closing spring and an opening spring, wherein said opening spring operates on the operating rod, said closing spring operates on one end of a crank whose other end is connected to a shaft fastened to a flywheel and on which is mounted a closing cam that cooperates with a roller on the operating rod;

a closing pawl configured to retain said closing spring in a compressed position, wherein opening said closing pawl releases said closing spring and causes rotation of the closing cam in a direction in which the closing cam closes the circuit-breaker and rearms said opening spring;

a rearming motor coupled by a freewheel mechanism to the shaft; and a pawl configured to trigger opening adapted to retain the operating rod against a force of said opening spring in a closed position of the circuit-breaker and to receive an opening command.

2. The spring-loaded operating mechanism claimed in claim 1, wherein said closing and opening springs are rectilinear and coaxial with the operating rod.

3. The spring-loaded operating mechanism claimed in claim 1, wherein said opening spring is mounted around the operating rod in a fixed cylindrical casing connected to the circuit-breaker, between a fixed bottom of the cylindrical casing and a bearing member connected to the operating rod in a vicinity of a free end of the operating rod.

4. The spring-loaded operating mechanism claimed in claim 3, wherein said closing spring surrounds the cylindrical casing and bears against a shoulder of the cylindrical casing and against a ring sliding along the cylindrical casing, at least one link being articulated to the ring sliding and to the one end of the crank.

5. The spring-loaded operating mechanism claimed in claim 1, wherein the roller is situated at a free end of the operating rod.

6. The spring-loaded operating mechanism claimed in claim 5, wherein the operating rod is surrounded by a hydraulic damper that comprises a piston fastened to the operating rod and a chamber in a form of a hollow cylinder through a bottom and a lid through which the operating rod passes.

* * * * *

UNITED STATES PATENT AND TRADEMARK OFFICE

CERTIFICATE OF CORRECTION

PATENT NO. : 6,917,006 B2
APPLICATION NO. : 10/501862
DATED : July 12, 2005
INVENTOR(S) : Bachofen It is certified that error appears in the above-identified patent and that said Letters Patent is hereby corrected as shown below:

On the title page, Items (86) and (87), the PCT information are incorrect. Items (86) and (87) should read as follows:

-- (86) PCT No.: PCT/FR03/00475

§ 371 (c)(1),
(2), (4) Date: Jul. 19, 2004

(87) PCT Pub. No.: WO03/071564

PCT Pub. Date: Aug. 28, 2003 --

Signed and Sealed this

Twelfth Day of September, 2006

JON W. DUDAS
*Director of the United States Patent and Trademark Office*